US007354381B2

(12) United States Patent
Greiner et al.

(10) Patent No.: US 7,354,381 B2
(45) Date of Patent: Apr. 8, 2008

(54) WEATHER AND PROTECTIVE COVER FOR A TRAMPOLINE

(76) Inventors: Jon Greiner, 1231 Madrone Ave., San Jose, CA (US) 95125-3548; Mark W. Publicover, 18505 Marshall La., Saratoga, CA (US) 95070-5647

( * ) Notice: Subject to any disclaimer, the term of this patent is extended or adjusted under 35 U.S.C. 154(b) by 0 days.

(21) Appl. No.: 11/226,854

(22) Filed: Sep. 14, 2005

(65) Prior Publication Data

US 2006/0058157 A1 Mar. 16, 2006

Related U.S. Application Data

(60) Provisional application No. 60/610,326, filed on Sep. 15, 2004.

(51) Int. Cl.
*A63B 5/11* (2006.01)

(52) U.S. Cl. ..... 482/29

(58) Field of Classification Search ..... 482/14, 482/26–29; D21/797; 472/93, 94
See application file for complete search history.

(56) References Cited

U.S. PATENT DOCUMENTS 1,409,746 A * 3/1922 McCord ..... 248/166
4,569,515 A * 2/1986 Gordon ..... 473/473
D382,618 S * 8/1997 Gift ..... D21/814
6,193,632 B1 * 2/2001 Steger ..... 482/27
6,846,271 B2 * 1/2005 Publicover ..... 482/27
6,984,195 B1 * 1/2006 Phillips ..... 482/71
2002/0137598 A1 * 9/2002 Publicover et al. ..... 482/27
2003/0060298 A1 * 3/2003 English ..... 472/93
2005/0148433 A1 * 7/2005 Wang et al. ..... 482/27

FOREIGN PATENT DOCUMENTS

CA 2121964 A * 10/1995
EP 107456 A1 * 5/1984
JP 08308971 A * 11/1996

* cited by examiner

*Primary Examiner*—Jerome Donnelly
*Assistant Examiner*—Victor K. Hwang
(74) *Attorney, Agent, or Firm*—Edward S. Sherman, Esq.

(57) ABSTRACT

A protective cover for a trampoline assembly that includes an attached safety enclosure has a plurality of edge cuts out coinciding with the connections of the bottom of the safety enclosure netting to the portions of the trampoline disposed with the diameter of the supporting frame. Elastic connecting members are provided at the intersection of each cutout with the periphery of the circular cover so that it is fastened to protect the trampoline frame and rebounding mat. The protective cover can be installed and removed without removing the safety enclosure.

11 Claims, 7 Drawing Sheets

FIG. 5A
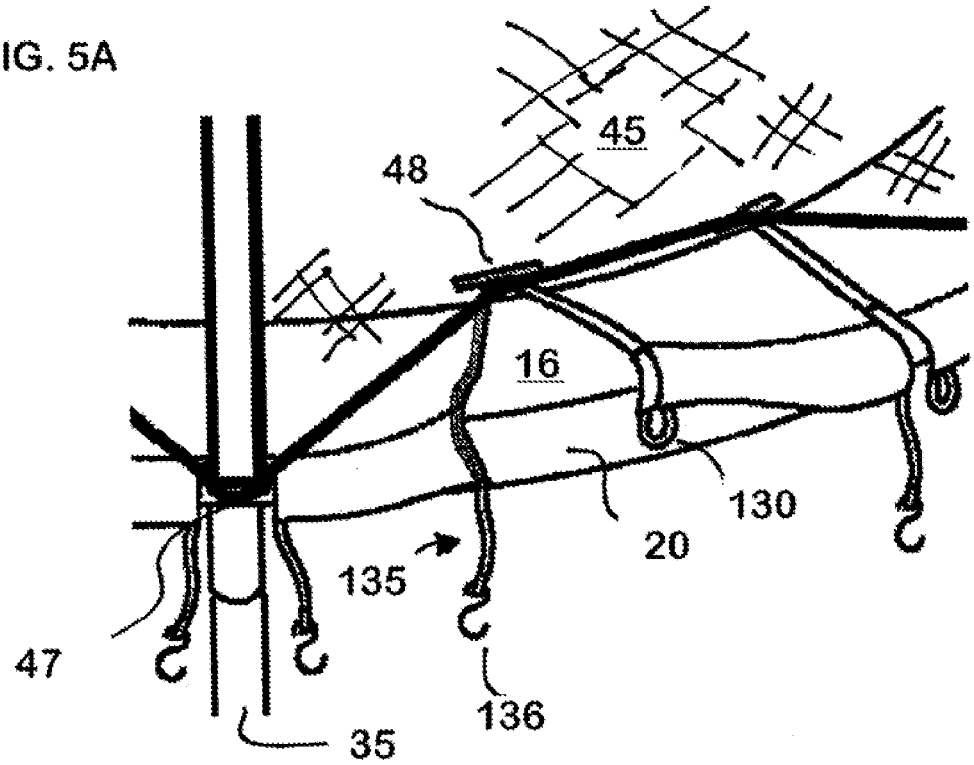
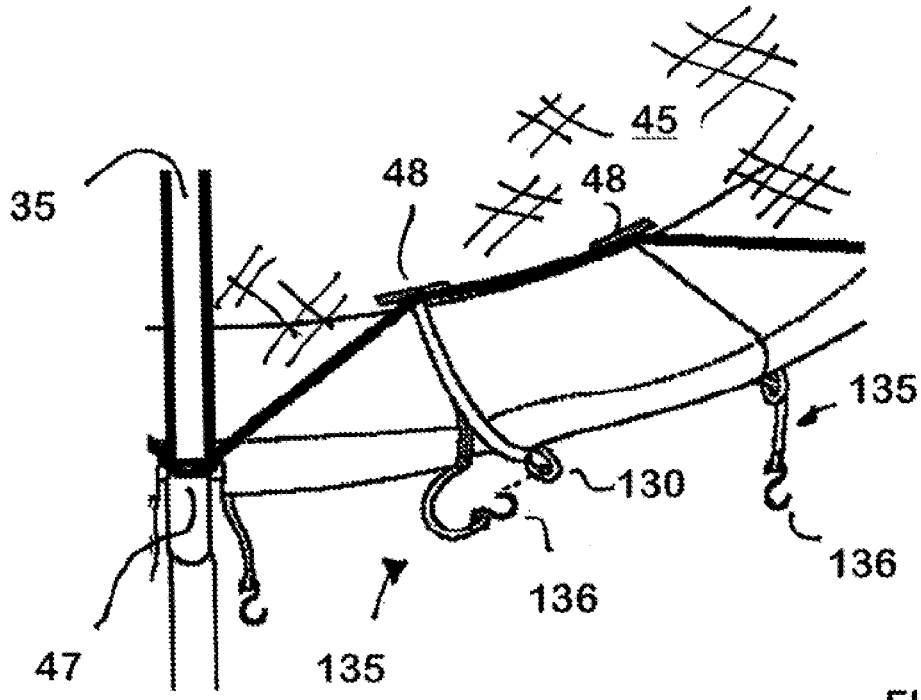
FIG. 5B

WEATHER AND PROTECTIVE COVER FOR A TRAMPOLINE

CROSS REFERENCE TO RELATED APPLICATIONS

The present application claims priority to the provisional application having Ser. No. 60/610,326 "Weather and Protective Cover for a Trampoline", Filed on Sep. 15, 2004 which is incorporated herein by reference.

BACKGROUND OF INVENTION

The present invention relates to a protective weather cover for a trampoline, in particular for a trampoline having a safety enclosure integrated therewith.

Safety enclosures have become commonplace for recreational trampolines. Such trampoline are frequently set up outside, for backyard use. Although the components of a trampoline can be made resistant to rain and inclement weather, the lateral surface of a trampoline can still catch and collect wind blown debris, such as leaves, dirt and dust particles, snow and the like.

As it is time consuming to clean the rebounding mat of debris, the use trampoline can be inherently discouraged during seasons of extended inclement weather.

Accordingly, there is a need for a protective cover for a trampoline that has an integral safety enclosure.

It is therefore an object of the present invention to provide a protective cover for a trampoline with a safety enclosure that is easy to securely install and remove, yet stays in place under most weather conditions to protect the rebounding surface from accumulating dirt and debris.

SUMMARY OF INVENTION

In the present invention, the first object is achieved by providing a substantially circular trampoline cover adopted to be inserted below the safety enclosure or netting that extends within the enclosed area that may include at least a portion of the padding used to cover the trampoline springs. The cover includes a plurality of cutouts to accommodate the portion of the netting that connect to the rebounding surface or any portion of the trampoline within the supporting frame.

Yet a further aspect of the invention is characterized in that cover is secured by elastic connecting members disposed at the intersection of each cutout with the periphery of the circular cover.

In a further aspect of the invention the elastic connecting member stretch the cover in the radial direction so that it is fully extended to cover protect the trampoline frame and the rebounding mat.

The above and other objects, effects, features, and advantages of the present invention will become more apparent from the following description of the embodiments thereof taken in conjunction with the accompanying drawings.

BRIEF DESCRIPTION OF DRAWINGS

FIGS. 5A and 5B are perspective views showing the method of attaching the portion of the trampoline cover shown in FIGS. 3A and B to the trampoline frame.

DETAILED DESCRIPTION

Figure 1A:
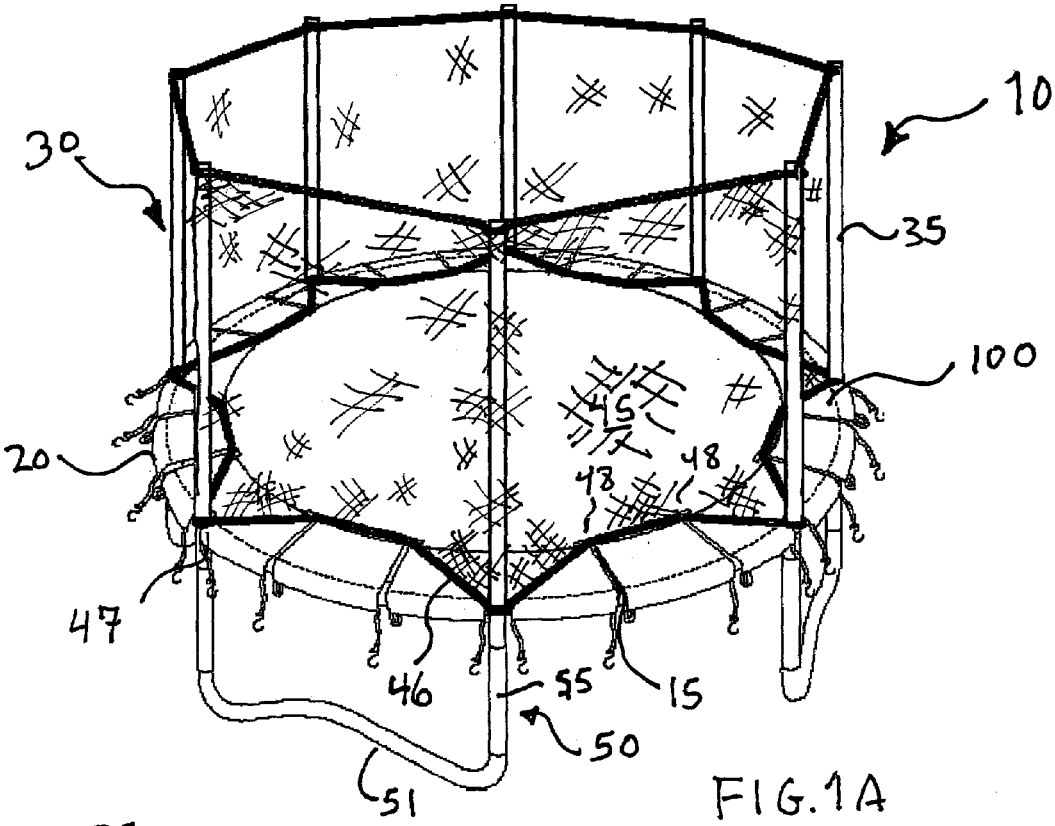
FIGS. 1A and B is a perspective view of the weather protective cover as installed on a trampoline having a safety enclosure.

Referring to FIGS. 1 through 7, wherein like reference numerals refer to like components in the various views, there is illustrated therein a new and improved trampoline cover, generally denominated 100 herein.

Figure 1B:
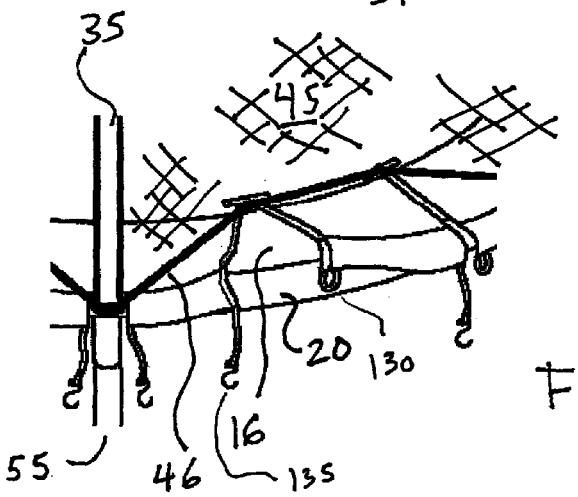

In accordance with the present invention, trampoline cover 100 is installed on trampoline that includes a safety enclosure 30. The trampoline structure 10 comprises a rebounding surface or mat 15 (but largely obscured in this view by the cover 100) stretched to a circular frame or ring 20 by a plurality of springs 25. The rows of springs 25 are covered with a protective mat 16, (largely obscured by protective cover 100 in this view). The safety enclosure 30 comprises a plurality of upright posts 35 that support and tension a length of netting 45 extending there around. The netting 45 is attached at its lower edge 46 to the springs 25, the rebounding mat 15 or the frame 20. Generally, the section of the netting 45 is connected to the edge of the rebounding mat 15 at two locations, denoted 48, between each pair of posts. However, other portion of the netting extend to the outside of the upright poles, at 47. The circular frame 20 is suspended above the ground by U-shaped legs 50. U-shaped legs 50 have a horizontal portion 51 and two upright vertical portions 55 extending from the ends thereof. Posts 35 preferably extend upward by attachment to or being a vertical extension of leg 55, as shown in the Figure. FIG. 1B indicates further details of the protective cover 16 and frame or ring 20 before they are covered by cover 100, as illustrated in the corresponding region of FIG. 1A.

Figure 2:
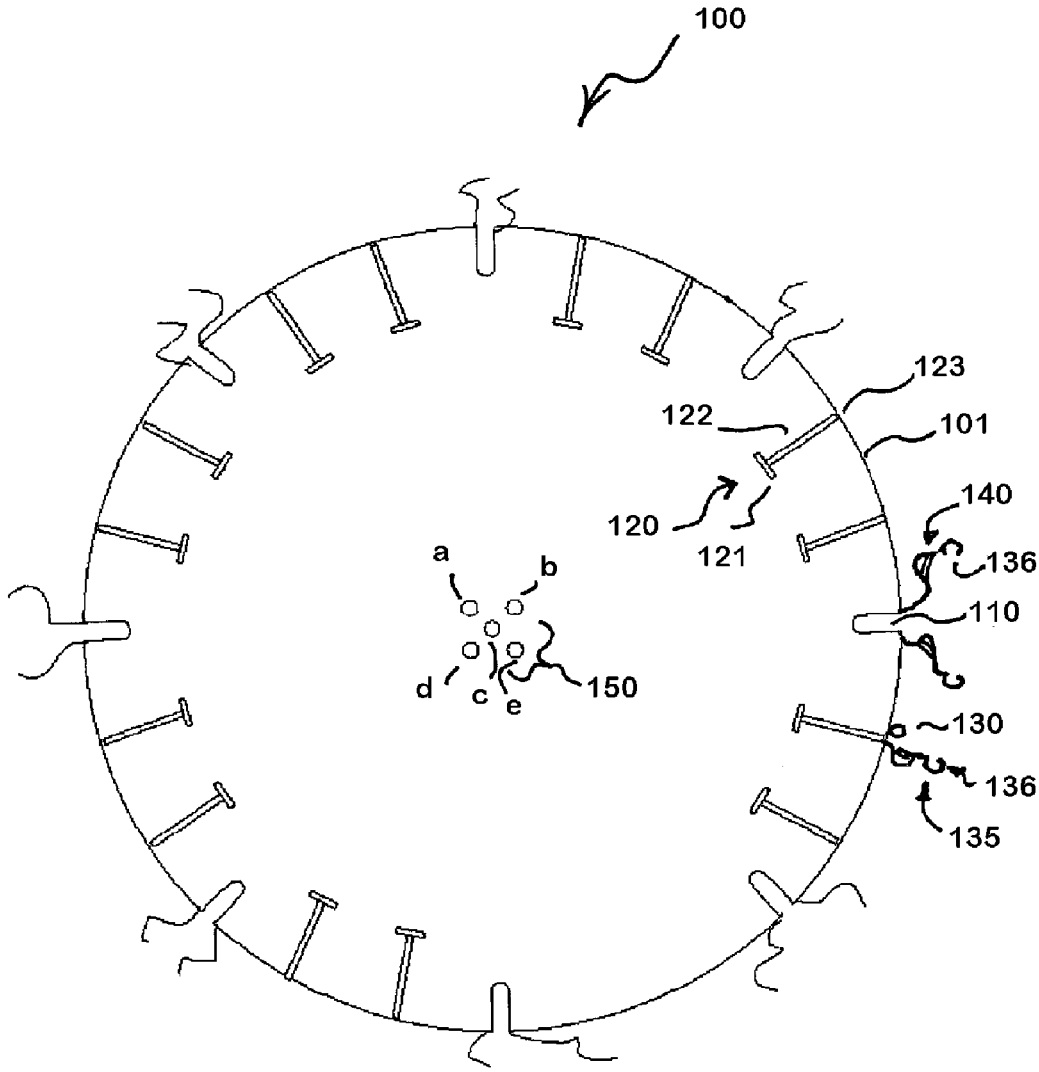
FIG. 2 is plan view of the weather protective cover of FIGS. 1A and B.

Referring to FIG. 2, further details of the structures that permit installation of the cover without the need to remove the safety enclosure 30 are illustrated in this plan view. These include a plurality of T-shaped cutouts 120, disposed around the periphery 101 of cover 100. The horizontal 121 and vertical 122 edges of the T-shaped 120 are lined with hook and loop fasteners (commonly referred to by the trade name "VELCRO") on opposing sides, as will be further described below with reference to FIG. 7. The T-shaped cutouts 120 are provided such that the margin of the cover can be slid to the supporting frame 20 of the trampoline with the cutouts passing through the connection points 48 wherein the rebound mat 15 is coupled to springs 25. Where the edge 123 of T-shaped cutout meets the periphery 101 of the cover 100 there are disposed, on opposing sides, an elastic hook 136 and ring 130 to secure the cover 100 to the trampoline assembly 10.

Disposed between each pair of T-shaped cutouts is a plurality of U-shaped cutouts 110, where the open top of the U portion corresponds with the periphery 101 of cover 100.

Each of the U-shaped cutouts is provided to accommodate the upright posts 35 that support the safety enclosures 10 and netting 45. Each of the two corners wherein the U meets the periphery 101 of cover 100 has a pair of elastic linear member 140 with a hook 145 disposed at the end thereof Each of the hooks associated with the U-shaped cutouts is provided to secure that region of the cover 100 to the trampoline assembly 10, as further illustrated in FIG. 4A and FIG. 4B. The trampoline cover 100 also includes a series of drain holes 150*a, b, c, d* and *e* disposed in the center thereof. A brass grommet preferably lines each drain hole. The drain holes prevent water from accumulating on top of the cover, allowing it to drain below and through the porous fabric, which forms the rebounding surface 15.

Figure 3A:
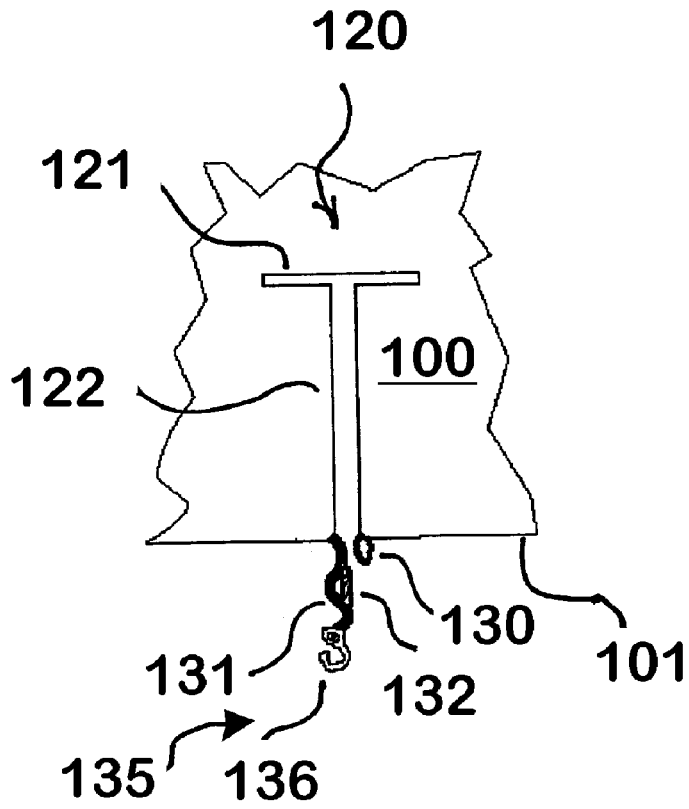
FIGS. 3A and 3B are plan views of selected portions of the weather protective cover of FIGS. 1A and B, as described in FIG. 2.
Figure 3B:
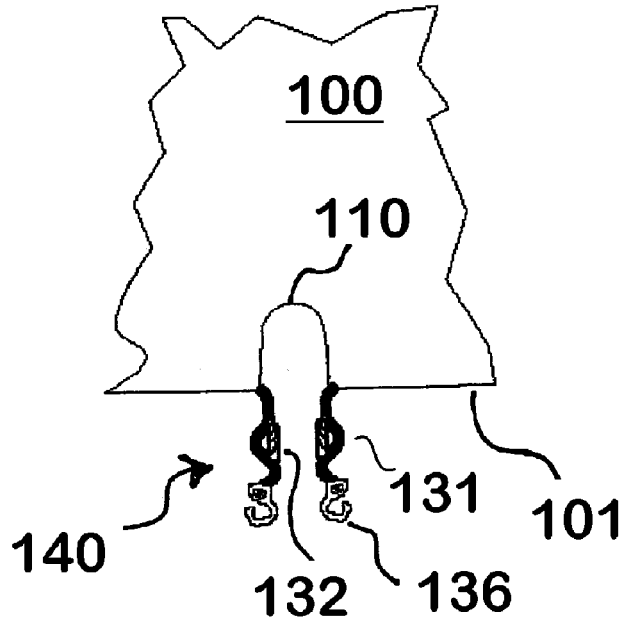
Figure 4A:
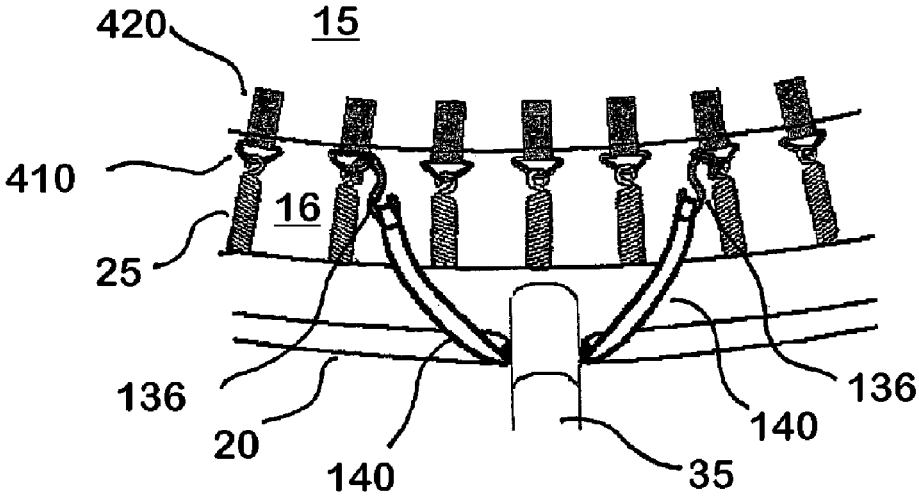
FIGS. 4A and 4B are perspective views showing the method of attaching the different portion of the trampoline cover shown in FIGS. 3A and B to the trampoline frame.
Figure 4B:
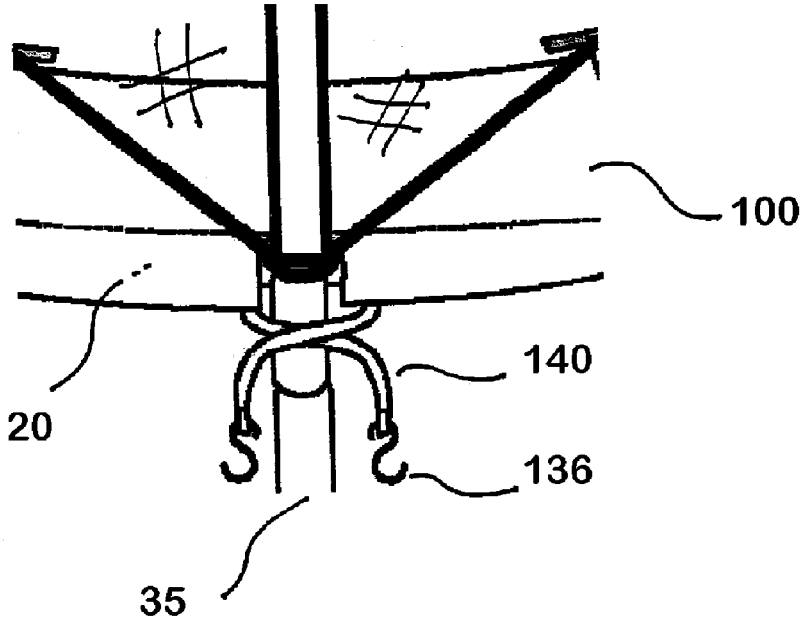

The method of installing and securing the trampoline cover at the U-shaped cutouts 110 at FIG. 3B is illustrated in detail in FIGS. 4A and 4B. FIG. 4A is from below the trampoline, whereas FIG. 4B is from above.

Figure 7:
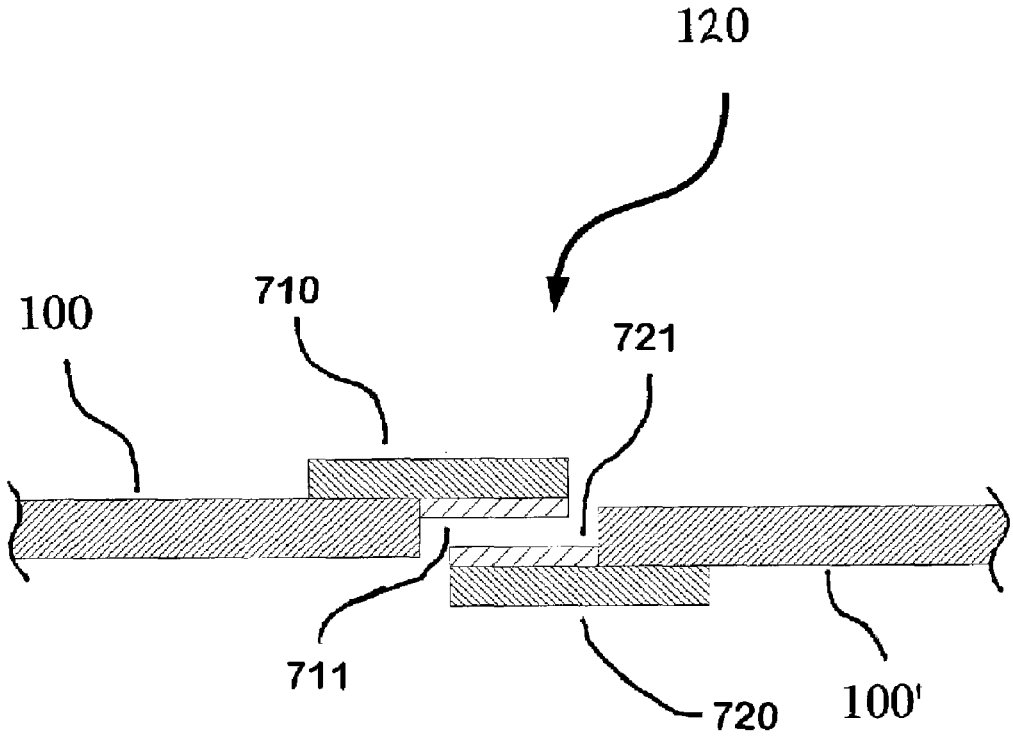
FIG. 7 is a cross-sectional elevation through the cover bisecting a T-shaped cutout to illustrate the method of closing the cutout after the cover has been installed over the trampoline rebounding mat.

The method of installing and securing the trampoline cover at T-shaped cutouts at FIG. 3A is illustrated in detail in FIGS. 5A and 5B. FIGS. 5A and 5B are both from above the trampoline, and along with FIG. 7, illustrate the method of joining the edges of the T-shaped cutouts, as well as attaching the elastic hook and ring together Thus, during installation with the safety enclosure in place one first lays out the weather cover on the trampoline rebounding mat. One then aligns the leg U-shaped cutouts 110 of the cover with the poles or post 35 of the safety enclosure (and legs of the trampoline). Next, the hook and loop, or "VELCRO" ™ type connections, shown in detail in FIG. 7, at the 16 locations corresponding to each of the T-shaped cutouts 120 on the weather cover are unfastened. Each section is then slid by pushing or pulling it under the trampoline safety enclosure net. This can be accomplished from any combination of movements from inside or outside of the trampoline.

As the net 45 should remain connected to the bed of the trampoline in 15 to 16 points and connections 48 that do not align with the T-shaped cutouts that open via the "Velcro" fasteners should be relocated to that they do align. Next, as shown in FIG. 7, from the outside of the trampoline the "VELCRO", connections are fastened. As shown in FIGS. 5A and 5B at the edge of each Velcro connection, an elastic cord or strap 135 with a hook 136 or bungee is inserted with hook through the adjacent loop 130, and then wrapped under the frame, by stretching the elastic strap 135 to attach the terminal hook portion 136 to the V-ring 410 on the bed of the trampoline. Thus, by extending the bungee to a V-ring so that the bungee is taut, and the skirt of the weather cover is drawn under the trampoline frame.

As shown in FIG. 4A, the V-rings 410 are used to secure the periphery 420 of the rebounding mat 15 to the plurality of springs 25 is secured to the rebounding mat by fabric loops that extend through the V-ring, having opposing sides stitched to the rebounding mat. To the extent that the trampoline is a double bed or rebounding mat configuration, one can follow the same methods by wrapping the elastic hooked fasteners under the lower rail and connect to the springs near the frame.

In contrast, as shown in FIGS. 4A and 4B, at each pole 35 the elastic members 140 disposed on each side of the U-shaped cut outs 110 are extended to that so that they cross each other, making an "X" on the outside of the trampoline leg, as shown in FIG. 4B, the hook portions 136 at the end are then pulled under the trampoline frame, and inserted within the V-rings 410 on the trampoline bed. In the case of a double bed trampoline, the hooks are preferably extended to connect to each other below lower trampoline rail or frame.

Figure 6:
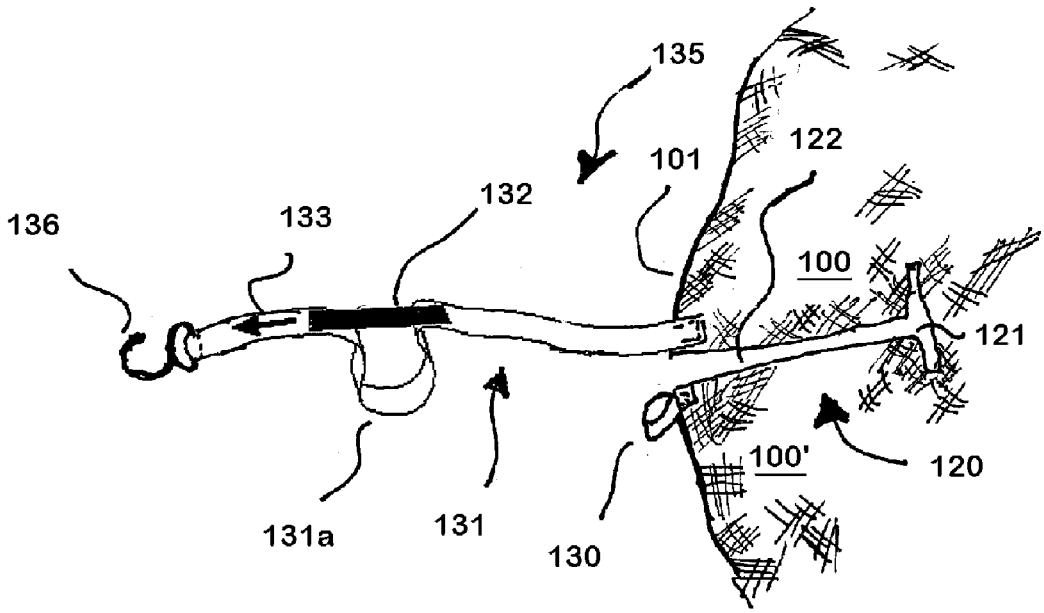
FIG. 6 is a perspective view showing details of the construction of the straps shown in FIGS. 3A and B, FIG. 4 and FIG. 5.

One embodiment of the construction of the elastic straps discussed with respect to FIGS. 4 and 5 are illustrated in further detail in FIG. 6. In this embodiment a flat strap portion 131 of elastic member 135 is sewn at one end to the periphery 101 of cover 100 adjacent the edge of T-shaped cutout 120. A loop 130 formed of flat strapping is sewn to the adjacent peripheral potion 101 of cover 100, on the opposite side of the slit that define the vertical portion of T-shaped cut-out 120.

Member or strap 135 is rendered elastic by stitching a short section of elastic strap material 132 to bridge between a partial loop or curled section 131*a* of flat strap 131. A hook 136 is attached to the opposite side of flat strap 131. Thus when the hook is pulled in the direction of arrow 133, to be inserted through loop 130 as shown in FIG. 4, the elastic strap portion 132 is extended, provide a retractile force that maintain the cover 100 when the hook 136 is secured into V-ring 410.

It should be appreciated that either of elastic members 135 and 140 associated with the T-shaped and U-shaped cutouts can be replaced by bungee type elastic cords and the like.

Further details of the T-shaped cutouts are provided in FIG. 7, showing an elevational cross-section through cover 100 at a T-shaped cutout. Opposing sides of the cover disposed across the T-shaped cutout 120 are designated 100 and 100'. A strip of fabric 710 is sewn on top of the right edge of the T-shaped cutout 120 with either the hook or loop portion of the hook and loop/"VELCRO" fastener 711 sewn to the portion of underside of fabric 710 that extends to the right edge of cover portion 100, for mating to portion 100'. Another strip of fabric 720 is sewn below the left edge of the T-shaped cutout 120 with the mating hook or loop portion of the hook and loop/"VELCRO" fastener 721 sewn to the upper side of fabric 720 that extends to the left of the edge of cover portion 100', for attachment to portion 100. Thus, after T-shaped slit is inserted around the junctions 48 between the protective netting 45 and the rebounding mat, the mating "VELCRO" fasteners are joined together to complete the assembly of the protective cover 100. It should be appreciated that it is preferable to provide the mating "VELCRO" fabric attachments on both the vertical 122 and horizontal 121 portion of each of the T-shaped cutouts 120.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

For example, it should be appreciated that the invention is not intended to be limited to using a circular piece of flexible material as the cover 100, as the shape can be varied to accommodate alternative shapes trampolines, as well as differences in the safety enclosure configuration. Specifically the T-shaped cutouts are optionally replaced with slits or even omitted when the safety enclosure is free standing or attaches to the ring or frame of the trampoline. In such instances, the U-shapes cutouts can be replaced by any configuration that accommodates the poles, regardless of their placement with respect to the remainder of the trampoline structure.

The invention claimed is:

1. A trampoline enclosure system comprising:

a) a trampoline having a rebounding surface that defines a reference plane, b) a surrounding frame, c) a plurality of springs for attaching the periphery of the rebounding surface in tension to said frame, d) a plurality of vertically-extending legs which support said frame and rebounding surface at an elevation above ground level;

e) a plurality of substantially upright support posts attached to the trampoline frame and extending above the rebounding surface to form an inner periphery boundary at the reference plane, f) a generally cylindrical wall made of a flexible material which is secured to the portions of said plurality of substantially upright support posts above the rebounding surface to define a chamber above the rebounding surface, and g) a protective cover disposed over the rebounding surface, the protective cover being formed of a sheet of flexible material and having a plurality of cut outs extending about the periphery thereof to accommodate and substantially conform to the shape of said substantially upright support posts at the reference plane of the rebounding surface, h) wherein the lower periphery of said generally cylindrical wall made of a flexible material is secured to at least a portion of the rebounding surface at the inner periphery boundary at the reference plane, i) wherein said protective cover further comprises:

(a) T-shaped slits that extend inward from the periphery thereof such that said protective cover can extend completely to cover the entire horizontal expanse of said rebounding surface and said springs, (b) elastic connecting members attached about the periphery of said protective cover to stretch said cover in the radial direction so that it is fully extended to cover and protect the rebounding surface, and (c) hook and loop fasteners attached to opposing edges in the slits of said protective cover.

2. A trampoline enclosure system according to claim 1 wherein said elastic connecting members attached about the periphery of said protective cover stretch said cover in the radial direction so that it is fully extended to cover and protect said rebounding surface and said springs.

3. A trampoline enclosure system according to claim 2 wherein said elastic connecting members comprises:

a) a first non-elastic flexible elongate member, b) a second elastic flexible elongate member, c) wherein the second elastic member in a relaxed state is connected to a partial loop or curled section of said first non-elastic flexible elongate member.

4. A trampoline enclosure system according to claim 1 further comprising one or more drain holes disposed in the center of said protective cover.

5. A trampoline enclosure system according to claim 1 wherein at least one of said elastic connecting members comprises:

a) a first non-elastic flexible elongate member, b) a second elastic flexible elongate member, c) wherein the second elastic member in a relaxed state is connected to a partial loop or curled section of said first non-elastic flexible elongate member.

6. A trampoline enclosure system according to claim 1 wherein at least one of said elastic connecting members comprises bungee type elastic cords.

7. A trampoline enclosure system comprising:

a) a trampoline having a rebounding surface that defines a reference plane, b) a surrounding frame, c) a plurality of springs for attaching the periphery of the rebounding surface in tension to said frame, d) a plurality of vertically-extending legs which support said frame and rebounding surface at an elevation above ground level;

e) a plurality of substantially upright support posts attached to the trampoline frame and extending above the rebounding surface to form an inner periphery boundary at the reference plane, f) a generally cylindrical wall made of a flexible material which is secured to the portions of said plurality of substantially upright supports above the rebounding surface to define a chamber above the rebounding surface, and wherein the lower periphery of said generally cylindrical wall made of a flexible material is secured to at least a portion of the rebounding surface inside the inner periphery boundary of said plurality of substantially upright support posts at the reference plane, g) a protective cover disposed over the rebounding surface, the protective cover being formed of a sheet of flexible material and having a plurality of cut outs extending about the periphery thereof to accommodate and substantially conform to the shape of said substantially upright support posts at the reference plane of the rebounding surface, wherein said protective cover further comprises;

i) slits that extend partially inward from the periphery thereof and then end such that said protective cover can extend completely to cover the entire horizontal expanse of said rebounding surface and said springs, wherein the length of each slit is substantially at least the distance between the periphery of the surrounding frame and the point of attachment of the lower periphery of said generally cylindrical wall made of a flexible material to the at least a portion of the rebounding surface, and ii) elastic connecting members attached about the periphery of said protective cover to stretch said cover in the radial direction so that it is frilly extended to cover and protect the rebounding surface.

8. A trampoline enclosure system according to claim 7 further comprising one or more drain holes disposed in the center of said protective cover.

9. A trampoline enclosure system according to claim 7 wherein at least one of said elastic connecting members comprises:

a) a first non-elastic flexible elongate member, b) a second elastic flexible elongate member, c) wherein the second elastic member in a relaxed state is connected to a partial loop or curled section of said first non-elastic flexible elongate member.

10. A trampoline enclosure system according to claim 7 wherein at least one of said elastic connecting members comprises bungee type elastic cords.

11. A trampoline enclosure system according to claim 7 further comprising hook and loop fasteners that attach pairs of opposing edges of the slits of said protective cover.

* * * * *